US006164077A

United States Patent [19]

Feger

[11] Patent Number: 6,164,077

[45] Date of Patent: Dec. 26, 2000

[54] THERMAL LINK DEVICE FOR A CRYOGENIC MACHINE

[75] Inventor: Damien Feger, Toulouse, France

[73] Assignee: Matra Marconi Space France, France

[21] Appl. No.: 09/277,945

[22] Filed: Mar. 29, 1999

[30] Foreign Application Priority Data

Mar. 31, 1998 [FR] France ..... 98 03971

[51] Int. Cl.[7] ..... F25B 9/00

[52] U.S. Cl. ..... 62/6; 62/51.1

[58] Field of Search ..... 62/51.1, 6; 165/104.21

[56] References Cited

U.S. PATENT DOCUMENTS

| | | | |
|---|---|---|---|
| 3,561,525 | 2/1971 | Baer | 165/105 |
| 3,894,403 | 7/1975 | Longsworth | 62/51.1 |
| 4,178,775 | 12/1979 | Smetana | 62/514 |
| 4,771,823 | 9/1988 | Chan | 165/61 |
| 4,802,345 | 2/1989 | Curtis | 62/514 |
| 4,967,564 | 11/1990 | Strasser | 62/47.1 |
| 5,228,703 | 7/1993 | White | 277/212 |
| 5,542,254 | 8/1996 | Pruitt | 62/6 |

FOREIGN PATENT DOCUMENTS

| | | |
|---|---|---|
| 0305257 | 3/1989 | European Pat. Off. . |
| 0823601 | 2/1998 | European Pat. Off. . |
| 1585049 | 6/1968 | France . |

*Primary Examiner*—William Doerrler
*Attorney, Agent, or Firm*—Larson & Taylor, PLC

[57] ABSTRACT

Thermal link device for use between an end surface of a cold finger of a cryogenic machine, at cryogenic temperature when in use, and a load, comprising:

a plate confronting said end surface, for connection with the load, mechanically separate from the end surface and defining a condensation and vaporization gap with said end surface, a capillary pumping element in said gap, a flexible wall defining an enclosure accommodating said gap and surrounding at least said end surface and a portion of a cold finger which is close to said end surface, and gas means in said enclosure, said gas means including at least one gas having a condensation temperature selected responsive to a cryogenic temperature to be given to the load.

9 Claims, 1 Drawing Sheet

THERMAL LINK DEVICE FOR A CRYOGENIC MACHINE

BACKGROUND OF THE INVENTION

The present invention relates to a thermal link device between the end of the cold finger of a cryogenic refrigerating machine and a load which is to be taken to a cryogenic temperature while it is in use.

The invention has a particularly important, although not exclusive, application when the refrigerating machine operates by using the Stirling cycle. The invention is nevertheless also suitable for use when said machine uses some other closed cycle or indeed an open cycle, e.g. the Joule-Thomson cycle.

Machines of the above kind deliver low temperature to the end, generally constituted by a thick cover, of a cold finger whose base is directly or indirectly in contact with an environment at a higher temperature. To reduce losses by conduction, a tube is used that has a very thin wall of material with low thermal conductivity, such as stainless steel or titanium. Since the tube is thin, it simultaneously presents very low mechanical strength and very low stiffness. Any force exerted on its end can consequently deform the cold finger, and that can have consequences that are particularly severe when the finger contains a moving element, as is the case in Stirling cycle machines.

Attempts have therefore been made to implement thermal link devices which simultaneously have low thermal resistance and apply only small forces to the end of the cold finger. In particular, thermal link devices have been made that are constituted by a braid of copper wires whose mass and stiffness are as small as possible. That solution is nevertheless not entirely satisfactory. A braid of low mass and stiffness has high thermal resistance. In order to assemble the braid to the cover of the cold finger, it is necessary to have direct access to the finger and to the load, and that is difficult to make compatible with achieving high performance thermal insulation. The fragility of the cold finger makes assembly difficult. In order for the braid to have the required flexibility, its length and volume must be large.

The use of a thermal braid suffers from an additional drawback when a single load is cooled by two machines, for the purpose of providing redundancy. If one of the machines is stopped, e.g. because of a breakdown, then the parasitic heat loss through the cold finger of that machine, which remains thermally linked to the load, is added to the power required by the load.

Also known, from U.S. Pat. No. 4,802,345, is a thermal link device between a cold finger and a load, the device being constituted by a narrow gap containing gases, at least one of which is incondensable at the operating temperature. The narrow size of the gap is essential and makes decoupling difficult.

Document U.S. Pat. No. 4,178,775 describes a cryostat for an infrared detector cooled by an open cycle refrigerator machine. Blotting paper retains liquefied gas close to the infrared detector. The blotting paper does not act as a pump, but only as a storage.

SUMMARY OF THE INVENTION

The invention seeks in particular to provide a thermal link device for a cryogenic machine that satisfies practical requirements better than previously known devices, in particular by reducing the temperature gradient between the end of the cold finger and the load, while avoiding any mechanical interference between the cold finger and the load and while enabling a small amount of mass and a small volume to be used with reduced assembly stresses.

To this end, the invention provides in particular a thermal link device for use between an end surface of a cold finger of a cryogenic machine, at cryogenic temperature when in use, and a load, comprising:

- a plate confronting said end surface, for connection with the load, mechanically separate from the end surface and defining a condensation and vaporization gap with said end surface,
- a capillary pumping element in said gap,
- a flexible wall defining an enclosure accommodating said gap and surrounding at least said end surface and a portion of the cold finger which is close to said end surface, and
- gas means in said enclosure, said gas means including at least one gas having a condensation temperature selected responsive to a cryogenic temperature to be given to the load.

The deformable wall can be constituted in particular by a thin-walled bellows having a rotational symmetry connecting a base of the cold finger to the vaporization plate. It is generally preferable to avoid fixing the bellows directly to the cold finger since it is very thin, generally about one-tenth of a millimeter thick.

The condensation and vaporization gap is generally about 1 mm to 10 mm across. The capillary pumping element interposed between the end of the finger and the plate reduces the amount of drops in formation that is entrained towards the outside by the gases. The pumping element can be of various different structures. It can be constituted by a pellet of wick-forming porous material occupying the gap that lies between the end of the cold finger and the plate. The pellet can, in particular, be made of silica felt, or of glass fiber, or of synthetic material with pores that are a few tens of microns in diameter. Liquid circulation from the periphery can also be facilitated by furrows etched in the end.

The plate can be extended by a jacket surrounding the end portion of the cold finger to prevent liquid droplets being entrained away from the gap by the gas which comes from vaporization.

Thermal insulation means, generally constituted by a Dewar flask, are provided around the enclosure and the load in order to reduce heat losses. Nevertheless, such insulation is not required when the device is designed to operate in space where a high vacuum prevails.

The above characteristics and others will appear more clearly on reading the following description of a particular embodiment, given as a non-limiting example. The description refers to the accompanying drawings.

DETAILED DESCRIPTION

Figure 1:
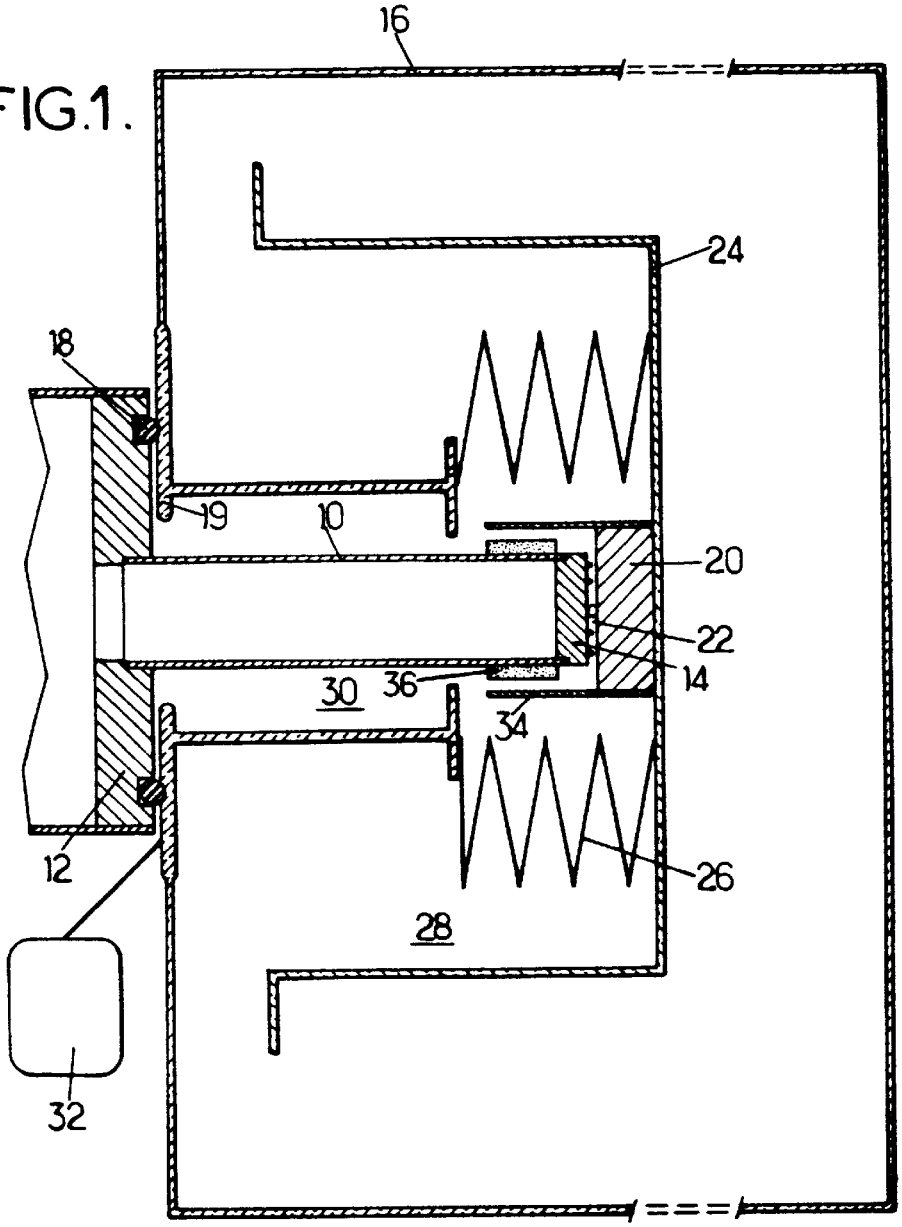
FIG. 1 is a cross sectional view of a device.

The device shown diagrammatically in FIG. 1 comprises a thin tube 10 having one end fixed to a base 12 belonging to a cryogenic machine and having its other end closed by a cover 14 which will, in general, be thicker than the cylindrical wall of the tube. The cover is generally an add-on item. However, it could be integral with the remainder of the tube. In general, the side wall of the tube is made of a material having a low thermal transmission coefficient, e.g.

stainless steel, titanium, or a titanium-based alloy. For a machine that is to supply cooling power of 1 W at 90 K, in ambient conditions having a maximum temperature of 300 K, the cold finger may have a diameter of 12 mm, a thickness of 0.1 mm, and a length of about 60 mm.

The device shown in FIG. 1 is for cooling a load contained in an evacuated cryostat. The cryostat has an outer casing 16, e.g. made of glass with an inside face that is silver-plated so as to be reflecting. The outer casing 16 is fixed to the base 12 by means (not shown), and sealing between the environment and a volume 30 as defined below is provided by an O-ring 18. An annular zone 19 of the casing for air-tight connection can be of increased thickness for increased stiffness.

The thermal link device comprises a plate 20 whose diameter is slightly greater than that of the cover 14 and having a face confronting the cover. The plate may be made of a metal having high thermal conductivity. It is designed to be rigidly connected to the load that is to be cooled (not shown). The plate can also be fixed to a partition 24 that can be considered as an inner envelope of the cryostat. This envelope is mechanically fixed to the outer casing 16 at locations that are not shown in the figure. A flexible wall shown as a flexible bellows 26 connects the end wall of the envelope 24 as carried by the plate 20 to a reinforcing annular zone 19 of the outer case 16.

The flexible wall thus separates an evacuated space 28 from an internal volume 30 surrounding the cold finger 10. Because of the flexibility of the bellows, the pieces 20 and 24 which are mechanically linked to the load, tolerate to relative movement that may take place between them and the pieces 18 and 16, and thus the end 14 of the cold finger.

The internal volume 30 is occupied by gas selected responsive to the temperature to which the plate 20 is to be taken. In particular, it is possible to use nitrogen, oxygen, air, or argon. Argon has the advantage of being an inert gas and of having a saturation curve that is slightly higher than that of nitrogen, thus giving rise to lower pressure when the temperature of the volume 30 is that of the environment on Earth, for a predetermined quantity of liquid at 90 K in the enclosure 30. A ballast tank 32 is often provided connected to the volume 30 so as to limit the pressure of the gas contained in the volume 30 when its temperature is that of the environment.

The nominal thickness of the gap 22 will typically be in the range 1 mm to 10 mm. This gap is occupied by a wick-forming porous member for causing liquid to flow by capillarity. The thickness of the gap can also be selected as a function of the accuracy which can be expected for positioning during assembly and as a function of the risk of displacement in operation, e.g. due to acceleration or to vibration.

For preventing drops formed on the cover 14 from being drawn towards a warmer portion of the cold finger, the plate 20 is advantageously extended by a jacket 34 surrounding the end portion of the cold finger. In order to ensure that the gas liquefies only on the cover 14, in front of the plate 20, the terminal portion of the side wall of the cold finger can be insulated by a sleeve 36 of thermally insulating material over a length of about a centimeter. The sleeve can typically be of expanded material having closed pores.

The device then operates as follows when the assembly shown in FIG. 1 is initially at ambient temperature. The volume 30 is filled with gas. When the cooling machine operates, the temperature of the gas decreases progressively. Finally, at the end of the cold finger, it reaches its liquefaction temperature. Drops of liquefied gas form and accumulate against the cover 14 where they grow, progressively invading the porous member. If the plate 20 is then at a temperature higher than the boiling temperature of the liquid at the pressure within the volume 30, then liquid vaporizes on coming into contact with the plate and absorbs heat. Vapor recondenses on the cover 14 and the cycle continues until the temperature of the plate 20 reaches that of the end of the cold finger. The gap 22 can then only contain liquid which will vaporize again if heat transfer by liquid conduction is insufficient to keep the plate 20 below boiling temperature. The gap 22 can act as a condenser of a heat pipe using the same gas as that present in the volume 30 and delivering cold to the plate 20 and if necessary to the wall 24.

In certain conditions, it will be advantageous to use a mixture of gases in the volume 30 so that the thermal link can operate over a wider temperature range: for example, by using a mixture of argon, methane, carbon dioxide, and ammonia it is possible to cover a range extending from ambient to −180° C. Thus, regardless of the temperature of the useful load, at least one of the gases is within its boiling range, while the others are in gaseous form, liquid form, or solid form and therefore have an effect on temperature transfer by conduction only. This option can be advantageous for applications that operate at varying temperatures or to facilitate the cooling transients of the system, making it possible to initialize the thermal link at temperatures that are higher than its set operating temperature.

The thermal gradient between the cover and the plate is very small, since boiling flux is generally 1 $W/cm^2$ to 10 $W/cm^2$, even in microgravity. No force is exerted by the load on the end of the cold finger since there is no mechanical link between the plate and the cold finger, given that the porous material has no significant rigidity. The nominal gap between the cover and the plate can be selected to have a value that is sufficient for compensating any manufacturing tolerances and any relative displacement. Because these tolerances are large, the cold finger can easily be integrated in a system. The plate 20 constitutes only a small amount of extra length, generally less than 10 mm.

In a system having a load provided with two machines for redundancy, leakage of heat due to a faulty machine can be very small since the stopping of a faulty machine causes the cold finger to heat up, the liquid to vaporize, and heat transfer to be reduced with transfer taking place between the cover and the plate only by conduction through the vapor.

As mentioned above, means can be provided to pump liquid towards the center of the cover. In particular, means can be provided that make use of capillary forces, e.g. radial furrows conveying liquefied gas from the periphery of the cover towards its center.

When the device is for operating in outer space only, i.e. in a vacuum, the cryostat can be omitted and under such circumstances, the bellows 26 is merely in connection between an annular plate sealingly connected to the base 12 (or the base itself) to an end wall extending the plate 20.

Figure 2:
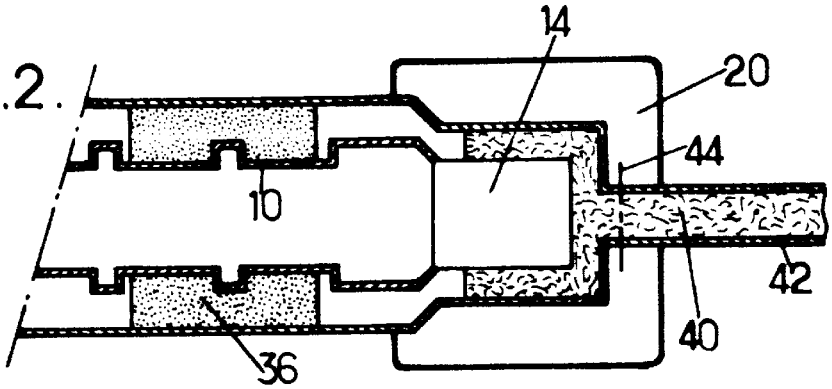
FIG. 2 shows a modified embodiment.

In FIG. 2, where members corresponding to those of FIG. 1 are given the same reference numerals, the pumping element 40 constitutes the condenser of a heat pipe 42 for cooling a remote load. For this purpose, the porous material 40 does not occupy only the zone facing the cold finger 14. It projects in a duct 42. The porous material gives rise to no mechanical coupling because of its texture. The liquid-gas interface 44 can move within the porous material responsive to the heat power delivered by the load. Internal grooves for returning gas towards the condenser-forming portion can be provided inside the duct 42.

What is claimed is:

1. An apparatus for cooling a load to a cryogenic temperature, comprising:

a cold finger of a cryogenic machine, said cold finger having an end cover closing a lateral tube which is thinner than said end cover, a plate for connection with the load, having a surface confronting an outer end surface of said end cover, mechanically separate from said end cover and defining a condensation and vaporization gap with said outer end surface, a capillary pumping element constituted by a pellet of wick-forming porous material, occupying said gap and in contact with the outer end surface and with said plate, wall means defining an enclosure around said cold finger, connecting said plate to a base of the cryogenic machine and accommodating said gap, said wall means having a flexible portion surrounding at least said outer end surface and an end portion of the cold finger which is close to said plate, and gas means in said enclosure, said gas means including at least one gas having a condensation temperature selected responsive to the cryogenic temperature to be given to the load.

2. System comprising a load and two cryogenic machines, each connected to said load by a device comprising a plate confronting an end surface of a cold finger of a respective one of said cryogenic machines, for connection with the load, mechanically separate from the end surface and defining a condensation and vaporization gap with said end surface, a capillary pumping element occupying the whole of said gap, a flexible wall defining an enclosure accommodating said gap and surrounding at least said end surface and a portion of the cold finger which is close to said end surface, and gas means in said enclosure, said gas means including at least one gas having a condensation temperature selected responsive to a cryogenic temperature to be given to the load.

3. Apparatus according to claim 1, further comprising a tubular extension of said plate, said extension surrounding said end portion of the cold finger for hindering shift of drops of liquefied gas out of said gap due to egress of said gas upon vaporization thereof.

4. Apparatus according to claim 3, further comprising a sleeve of thermally insulating material surrounding the end portion of the lateral wall of the cold finger and in contact therewith.

5. Apparatus according to claim 1, wherein the deformable wall is a flexible bellows having a rotational symmetry, connecting a base of said cold finger and said plate.

6. Apparatus according to claim 1, further comprising thermally insulating means around the enclosure and the load, formed as a Dewar whose inner wall is said enclosure.

7. Apparatus according to claim 1, wherein said gas means consist of a mixture of a plurality of gases having different boiling temperatures.

8. Thermal link device for use between an end surface of a cold linger of a cryogenic machine, at cryogenic temperature when in use, and a remote load, comprising:

a plate confronting said end surface, for thermal connection with the load, mechanically separate from the end surface and defining a condensation and vaporization gap with said end surface, a capillary pumping element occupying the whole of said gap and extending into a duct up to said load for constituting a condenser of a heat pipe extending from said end surface to said remote load, a flexible wall defining an enclosure accommodating said gap and surrounding at least said end surface and a portion of the cold finger which is close to said end surface, and gas means in said enclosure, said gas means including at least one gas having a condensation temperature selected responsive to a cryogenic temperature to be given to the load.

9. Apparatus according to claim 2, wherein capillary radial furrows are formed in said outer end surface.

* * * * *